US006343199B1

(12) United States Patent
Kodama

(10) Patent No.: US 6,343,199 B1
(45) Date of Patent: Jan. 29, 2002

(54) CHARGING DEVICE, CHARGING ROLLER, AND IMAGE FORMING APPARATUS

(75) Inventor: Masataka Kodama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/691,169

(22) Filed: Oct. 19, 2000

(30) Foreign Application Priority Data

Oct. 22, 1999 (JP) ..... 11-301064

(51) Int. Cl.[7] ..... G03G 15/02

(52) U.S. Cl. ..... 399/174; 361/225; 399/176; 492/30

(58) Field of Search ..... 399/174, 176; 361/225; 430/902; 492/30, 37

(56) References Cited

U.S. PATENT DOCUMENTS 5,809,379 A 9/1998 Yano et al.

6,212,346 B1 * 4/2001 Hirabayashi ..... 399/176

FOREIGN PATENT DOCUMENTS

| | | | |
|---|---|---|---|
| JP | 6-3921 | | 1/1994 |
| JP | 9-50161 | * | 2/1997 |
| JP | 11-65231 | | 3/1999 |
| JP | 2000-81752 | * | 3/2000 |

* cited by examiner

*Primary Examiner*—Joan Pendegrass
(74) *Attorney, Agent, or Firm*—Fitzpatrick, Cella, Harper & Scinto

(57) ABSTRACT

A charging device is formed of a member to be charged, a charging member disposed so as to form a nip with the member to be charged, and electroconductive particles disposed so as to be present at the nip between the photosensitive member and the member to be charged. A uniform direct injection charging performance is realized by providing the charging member with a fine network-textured surface having concave cells giving a total cell edge perimeter per unit area of 15 mm/mm$^2$ to 60 mm/mm$^2$.

18 Claims, 3 Drawing Sheets

CHARGING DEVICE, CHARGING ROLLER, AND IMAGE FORMING APPARATUS

FIELD OF THE INVENTION AND RELATED ART

The present invention relates to a charging device for charging a member to be charged in contact with the member to be charged, an image forming apparatus, such as a copying machine and a printer, and a process cartridge detachably mountable to the image forming apparatus. The present invention also relates to a charging roller included in the charging device.

Hitherto, in image forming apparatus such as an electrophotographic apparatus and an electrostatic recording apparatus, a corona charger (corona discharger) has been frequently used as a charging device for uniformly charging an image bearing member (member to be charged) such an electrophotographic photosensitive member and an electrostatic recording dielectric member to a prescribed potential of a prescribed polarity. The corona charger is a non-contact type charging device and typically has an organization including a discharge electrode, such as a wire electrode, and a shield electrode disposed so as to surround the discharge electrode except for a discharge opening. The discharge opening is directed toward and free of contact with an image bearing member as a member to be charged, whereby an image bearing surface of the image bearing member is charged by exposure to a discharge current (corona shower) caused by applying a high voltage between the discharge electrode and the shield electrode.

In recent years, in view of advantages such as lower ozone generation and lower power consumption compared with such a corona charger, a contact-type charging device (contact charging device) as mentioned above, wherein a charging member supplied with a voltage abuts against a member to be charged to charge the member to be charged, has been commercialized.

More specifically, such a contact charging device includes an electroconductive charging member of a roller-type (charging roller), a fur brush-type, a blade-type, etc., which is caused to contact a member to be charged, such as an image bearing member, and is supplied with a prescribed charging bias voltage to charge a surface of the member to be charged to a prescribed potential of a prescribed polarity.

The charging mechanism in the contact charging includes two types of mechanisms, i.e., (1) a discharge charging mechanism and (2) a direct injection charging mechanism, in mixture, and various charging characteristics appear depending on which of the two mechanisms is dominant. FIG. 4 illustrates charging characteristic curves according to the representative of the respective mechanisms, which are characterized as follows.

(1) Discharge Charging Mechanism

According to this mechanism, a surface of the member to be charged is charged by a discharge phenomenon occurring at a minute gap between the contact charging member and the member to be charged. As the discharge phenomenon occurs above a certain discharge threshold voltage between the contact charging member and the member to be charged, it is necessary to supply the contact charging member with a voltage larger than a charge potential provided to the member to be charged. Further, according to this mechanism, the occurrence of discharge by-products is inevitable in principle while the amount thereof is remarkably less than in the case of a corona charger, so that difficulties such as the occurrence of ions caused by active ions can not be completely obviated.

For example, while the roller charging scheme, using a conductive charging roller as a contact charging member, is preferred in view of its charging stability and is widely used, the discharge charging mechanism is generally predominant in the roller charging scheme.

More specifically, a charging roller is generally formed of a conductive or medium-resistivity rubber material or foam product, which may be laminated with another layer to provide desired properties. The charging roller is provided with an elasticity so as to form a certain width of contact (nip), which results in a large friction during its movement following the movement of the member to be charged at an identical speed or with a slight speed difference. During this contactive movement, some non-contact state is inevitably caused due to a surface shape-irregularity of the roller and material attached to the member to be charged, which promotes the discharge charging mechanism. Thus, as the charging is effected by discharge from the charging member onto the member to be charged, the charging is started by application of a voltage in excess of a certain threshold voltage. For example, in a case where a 25 $\mu$m-thick OPC photosensitive member (photosensitive layer) as a member to be charged is charged by means of a charging roller abutted thereto, the surface potential of the photosensitive member starts to increase when a voltage of approximately 640 volts or higher is applied to the charging roller, and is increased thereafter linearly in proportion (at a rate of 1) to the increase in the applied voltage (2) Direct injection charging mechanism.

According to this mechanism, a surface of a member to be charged is charged with charges directly injected from the contact charging member to the member to be charged as proposed in Japanese Laid-Open Patent Application (JP-A) 6-3921 and JP-A 11-65231.

In the direct injection charging mechanism, charges are directly injected to the surface of the member to be charged by the direct contact of a medium-resistivity contact charging member to the surface of the member to be charged basically without relying on the discharge mechanism. Accordingly, the member to be charged can be charged to a potential proportional to the voltage applied to the charging member even at an applied voltage below the discharge threshold votlage as represented by a solid line in FIG. 4. The direct injection charging mechanism is not accompanied by the occurence of ions and is therefore free from the difficulties of discharge byproducts.

More specifically, a contact charging member, such as a charging roller, a charging brush or a charging magnetic brush, is supplied with a voltage to inject charges to charge-retaining means, such as a trap level present at the surface of the member to be charged (image-bearing member) or electroconductive particles in a charge-injection layer formed at the surface of the member to be charged. As the discharge phenomenon is not preodiminant, the necessary voltage applied to the charging member is only a desired potential to be provided to the member to be charged, so that the occurrence of ozone can be obviated. The use of a porus roller, such as a sponge roller, coated with electroconductive particles for promoting the contact charging performance as a contact charging member, is known to be effective for enhancing a dense contact between the contact charging member and the member to be charged. surface of the member to be charged. As the discharge phenomenon is not predominant, a necessary voltage applied to the charging member is only a desired potential to be provided to the member to be charged, so that the occurrence of ozone can be obviated. The use of a porous roller, such as a sponge roller, coated with electroconductive particles for promoting the contact charging performance as a contact charging member, is known to be effective for enhancing a dense contact between the contact charging member and the member to be charged.

However, it is not an easy matter to sufficiently charge a member to be charged by using a simple device structure including a charging roller, so that charging irregularity is liable to be caused due to local charging failure. The charging irregularity leads to image irregularity in the resultant images. The charging irregularity may be ascribed to failure in effective retention of electroconductive particles coating the sponge roller for enhancing the injection charging because the sponge cell is provided with sponge cells formed by gas generation caused by decomposition of a foaming agent in a larger size and in a lower density than expected.

SUMMARY OF THE INVENTION

Accordingly, a principal object of the present invention is to provide a contact charging device of the type wherein a member to be charged is charged by a charging member with the aid of electroconductive particles disposed between the charging member and the member to be charged, allowing uniform direct injection charging.

Another object of the present invention is to provide an image forming apparatus including such a charging device.

A further object of the present invention is to provide a charging roller suitably included as a charging member in such a charging device.

According to the present invention, there is provided a charging device, comprising: a member to be charged, a charging member disposed so as to form a nip with the member to be charged, and electroconductive particles disposed so as to be present at the nip between the charging member and the member to be charged, wherein the charging member has a fine network-textured surface provided with concave cells giving a total cell edge perimeter per unit area of 15 mm/mm$^2$ to 60 mm/mm$^2$.

According to the present invention, there is further provided an image forming apparatus, comprising: a photosensitive member, a charging member disposed so as to form a nip with the photosensitive member, and electroconductive particles disposed so as to be present at the nip between the charging member and the photosensitive member, wherein the charging member has a fine network-textured surface provided with concave cells giving a total cell edge perimeter per unit area of 15 mm/mm$^2$ to 60 mm/mm$^2$.

The present invention further provides a process cartridge, comprising: a photosensitive member, a developing means and a charging means integrally supported to form a cartridge which is detachably mountable to a main assembly of an image forming apparatus, wherein the charging means includes a charging member disposed so as to form a nip with the photosensitive member, and electroconductive particles disposed so as to be present at the nip between the charging member and the member to be charged, wherein the charging member has a fine network-textured surface provided with concave cells giving a total cell edge perimeter per unit area of 15 mm/mm$^2$ to 60 mm/mm$^2$.

The present invention also provides a charging roller, having a fine network-textured surface provided with concave cells giving a total cell edge perimeter per unit area of 15 mm/mm$^2$ to 60 mm/mm$^2$.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 2:
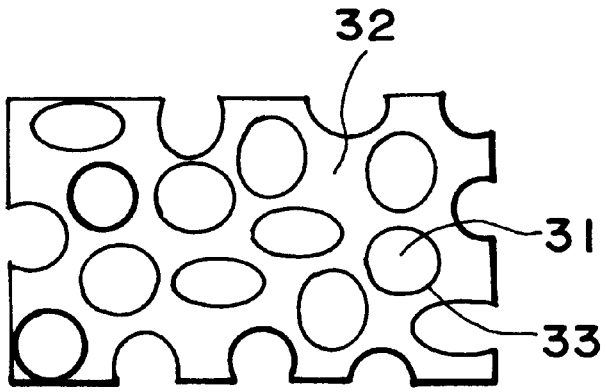
FIG. 2 is a schematic plan view for illustrating a network-textured surface of a charging member constituting a charging device according to the invention.

The charging device of the present invention includes a charging member having a fine network-textured surface provided with concave cells giving a total cell edge perimeter per unit area which is controlled to be in the range of 15–60 mm/mm$^2$. As a result, uniform charging can be realized in a contact charging scheme in which the injection charging mechanism is predominant. Herein, the term cell edge refers to the periphery of each of a multiplicity of concave cells or surface concavities which in combination provide the fine network-textured surface of the charging member. FIG. 2 is a partial plan view for illustrating a surface network texture of a sponge (or foam rubber) charging member. Referring to FIG. 2, the surface network texture is formed of cells (or cell concavities) 31 defined by cell edges 33, and cell walls 32 forming a projecting surface of the charging member. The excellent uniform charging performance of the charging device according to the present invention may be ascribed to the following factors. The total cell-edge perimeter per unit area (1 mm$^2$) (i.e., cell edge perimeter density) of 15–60 mm/mm$^2$ basically represents the abundant presence of small-size cells at the surface. If the surface cells are assumed to have true circular shapes, in some typical cases of distribution, a cell-edge-perimeter density of 15 mm/mm$^2$ represents the presence of approximately 100 $\mu$m-diameter cells at a cell density (i.e., an areal proportion of cells occupying a total surface area of the charging member) of approximately 40%, 60 mm/mm$^2$ represents approximately 25 $\mu$m-diameter cells at a cell density of approximately 40%, and 20 mm/mm$^2$ represents approximately 100 $\mu$m-diameter cells at a cell density of approximately 50%. The degree of promotion of injection charging performance by the (electro)conductive particles is proportional to the number of conductive particles retained at the nip between the charging member and the member to be charged. The cell walls 32 forming a flat convex region exhibit a smaller conductive particle-retaining ability, so that the conductive particles cannot be effectively present thereat. On the other hand, the concave cells 31 exhibits a large conductive particle-retaining power and can retain much conductive particles. Accordingly, a larger cell-area density (compared with a cell wall area) is preferred in order to promote the injection charging performance. Further, in view of a typical case where the charging member and the member to be charged are moved with a relative speed difference at the nip therebetween so as to rub each other at the nip, the conductive particles retained in the concave cells 31 are swept to one edge side of the cells, and accordingly if the cell size is large, the spacing between the cell edges where the conductive particles are present is increased, so that the injection charging promotion effect by the conductive particles is liable to be non-uniform. Accordingly, a smaller cell size is generally preferred for causing uniform injection charging. However, too small a cell size results in a small conductive particle-retention power by the cells. In view of the uniform distribution and effective retention of conductive particles at the concave cells, a cell-edge-perimeter density of 15–60 mm/mm$^2$ is effective. According to our study, the cell size and the cell wall thickness in the charging members used heretofore have been generally too large, so that the cell-edge-perimeter density thereof has been smaller than that in the charging member of the present invention.

Figure 1:
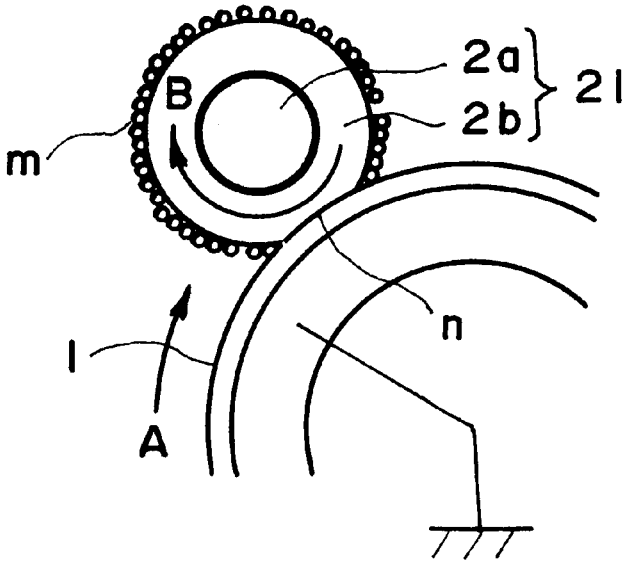
FIG. 1 is a partial schematic sectional view of an embodiment of the charging device according to the invention for illustrating an organization and an operation thereof.

FIG. 1 is a schematic sectional view of an embodiment of the charging device according to the present invention. Referring to FIG. 1, the charging device includes a charging roller 21 (as a charging member) and a photosensitive member 1 (as a member to be charged) which are disposed to form a nip n therebetween. According to the present invention, the charging roller 21 is formed with a porous surface layer of, e.g., sponge or foam rubber, providing a network-textured surface giving a cell edge perimeter density of 15–60 mm/mm$^2$, preferably 20–50 mm/mm$^2$. As a result, the charging roller 21 allows a sufficient contact with the photosensitive member 1 surface while uniformly rubbing the photosensitive member surface with the conductive particles sufficiently retained at the surface thereof, thus allowing a smooth direct transfer of charge therefrom to the photosensitive member surface. Accordingly, the charging roller according to the present invention can exhibit a high charging performance not attainable by a conventional roller charging scheme principally relying on the discharge charging mechanism, whereby a potential almost close to a potential applied to the charging roller 21 can be provided to the photosensitive member 1. Thus, the charging roller 21 is required to be supplied with a bias voltage comparable to a potential to be provided to the member to be charged, by realizing a stable and safe direct charging (injection charging) without substantially relying on the discharge phenomenon.

It is preferred that the charging roller 21 and the photosensitive member 1 are moved with a relative speed difference so as to rub each other. For this purpose, the photosensitive member 1 and the charging roller 21 may be moved at mutually different surface speeds in an identical direction or moved in mutually opposite directions as represented by arrows A and B in FIG. 1.

The charging roller 21 may be formed by coating a core metal 2*a* with an elastic layer 2*b*. The elastic laye 2*b* may be found of a composition including an elastomer (e.g., EPDM (ethylene propylene-diene terpolymer)), conductive particles (e.g., carbon black), a vulcanizer, a foaming agent, etc. The composition may be extruded and heated for curing into a form of a cylindrical tube 2*b*, into which the core metal 2*a* is tightly inserted to provide a rolelr structure, whose surface is then generally abraded to provide the charging roller 21. As a result of the abrasion, the charging roller 21 is provided with a network-textured surface provided with concave cells seperated by cell walls. The network texture of the surface including the cells and cel walls can be formulated into various states by selecting the vulcanizer, the forming agent and/or the heating means as will be described with reference to Examples and Comparative Examples. Further, such a fine network texture giving such surface uneveness may also be provided by selective elution of a lowmolecular weight substance admixed with a polymeric material to form a porous body, or surface treatment of a non-foam body, e.g., by abrasion or etching.

In the above-mentioned preferred mode of formation of an elastomeric layer having a network-textured surface through and curing of an elastomer, it is possible to provide a network-textured surface exhibiting a prescribed cell-edge-perimeter density by approximately selecting the species of the foaming agent and vulcanizer, the foaming condition, the vulcanization condition, etc. For example, a smaller cell size can be provided by causing thermal decomposition of a foaming agent after the curing of the elastomer has proceeded to some extent, i.e., in a higher viscosity state of the elastomer. Further, if the foaming is caused under heating with steam, a large number of cells can be formed while surpressing the cell size owing to the steam pressure. In a preferred case of forming EPDM elastomer to provide a network texture, it is particularly suitable to adopt a combination including azodicarbonamide as a foaming agent, a thiazole compound and a dithiocarbamate compound as vulcanization promoters, and sulfur as a vulcanizer. More specifically, in this case, it is preferred to use 3–5 wt. parts of the thiazole compound and dithiocarbamate compound per 100 wt. parts of EPDM. In order to provide the cell-edge-perimeter density of 15'60 mm/mm$^2$, the elastomer may preferably be foamed to provide a specific gravity in a range of 0.2–0.65. A high foaming ration giving such a low specific gravity provides a lower roller hardness to ensure the necessary nip width between the charging roller and the photosensitive member required for charge transfer therebetween, thus providing an improved charging efficiency. However, too high a foaming ration results in an insufficient strength of the charging roller, which leads to a worse charging performance due to deformation. Accordingly, the foaming ration may preferably be in the range of 1.5 to 5.0 as calculated by the following equation:

Forming ratio=(specific gravity of elastomer composition before vulcanization and foaming)/(specific gravity after vulcanization and foaming)

It is important for the charging roller to function as an electrode. Accordingly, in addition to an elasticity for ensuring a sufficient contact with a member to be charged, the charging roller is required to have a sufficiently low resistance suitable for charging a moving member to be charged. On the other hand, the charging roller is required to prevent voltage leakage even at a defect, such as a pinhole, possibly present on the member to be charged. Accordingly, in the case where an electrophotographic photosensitive member is used as the member to be charged, the charging roller may preferably have a resistance of 104–107 ohm so as to exhibit a sufficient charging performance and a sufficient leakage resistance.

As for the hardness of the charging roller, too low a hardness results in a lower shpe stability and a poor contact state, and too high a hardness leads to failure in ensuring a charging nip and inferior microscopic contact with the photosensitive member surface, so that the charging roller may preferably have an Asker C hardness in a range of 25 deg. to 50 deg.

The elastic layer 2*b* of the charging roller 21 may preferably comprise an elastomer, such as EPDM (ethylene-propylene rubber), urethane rubber, NBR (nitrile-butadiene rubber), silicone rubber or IR (butyl rubber), blended with an electroconductive substance, such as carbon black or a metal oxide, to be dispersed therein for resistance adjustment. The resistance adjustment can also be effected by using an ionically conductive elastomeric material without particularly dispersing an electroconductive substance, or can be effected by using a mixture of a metal oxide and an ionically conductive material.

The charging roller is operated in the form of being coated with conductive particles m as shown in FIG. 1. The conductive particles may comprise particles of metal oxides, etc., blends thereof with an organic material, or surface-coated products of these. The metal oxides may for example include: zinc oxide, tin oxide/antimony oxide complex oxide, and titanium oxide/tin oxide complex oxide. The organic materials may for example include: polypyrrole and polyaniline.

The conductive particles may preferably have a specific resistance of at most $10^{12}$ ohm.cm.

Specific resistance values described herein are based on values measured according to the tablet method as follows. Namely, approximately 0.5 g of a powdery sample is placed in a cylinder having a bottom area of 2.26 $cm^2$, and sandwiched under a load of 15 kg between upper and lower electrodes. In this state, a resistance value is measured while applying a voltage of 100 volts and normalized to obtain a specific resistance value.

The conductive particles may preferably have an average particle size (50%-average particle size) of at most 50 $\mu$m based on observation through an optical or electron microscope wherein agglomerated particles are observed as such (i.e., not based on primary particles thereof) and the particle size of each individual particle is measured as a maximum chord span taken in a single (e.g., horizontal) direction for at least 100 particles selected at random to obtain a volume-basis particle size distribution, from which a particle size (diameter) cumulatively giving 50%-volume is determined as an average particle size. The conductive particles may further preferably have an average particle size of at least 10 nm so as to allow uniform production of the particles, and preferably at least 0.3 $\mu$m for effective araticle size control.

Figure 5:
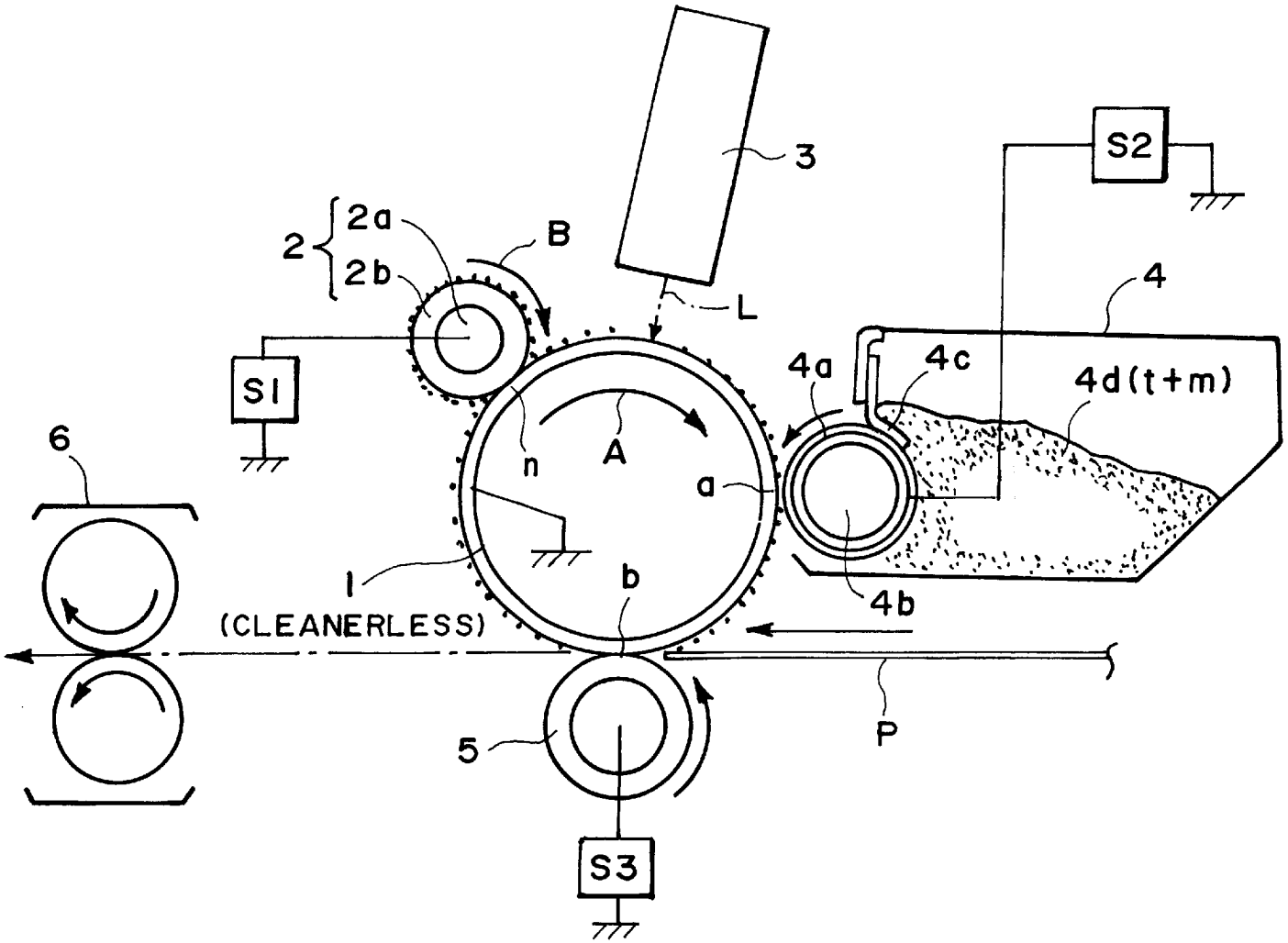
FIG. 5 is a schematic sectional illustration of an image forming apparatus including a charging device of the invention.

Next, an embodiment of image forming apparatus including a charging device according to the present invention will now be described with reference to FIG. 5. FIG. 5 illustrates a cleanerless-type of electrophotographic image forming apparatus, which is not equipped with a cleaning means for the photosensitive member but allows toner recycling. Referring to FIG. 5, the image forming apparatus includes a drum-shaped photosensitive member 1, around which are disposed a charging roller 2, an exposure means 3, a developing device 4, a transfer charger 5 and a fixing device 6. The developing device, photosensitive member and charging roller can be integrated into a process cartridge, which can be detachably mountable to a main assembly of the image forming apparatus.

In a specific embodiment (adopted in Examples described hereinafter), the image forming apparatus shown in FIG. 5 was organized in the following manner.

The charging roller 2 was abutted to the photosensitive member 1 as a member to be charged at a prescribed pressing force in resistance to the elasticity thereof, so as to form a charging nip n of 3 mm between the photosensitive member 1 and the charging roller 2. The charging roller 2 was rotated in an indicated arrow B direction at a rate of 80 rpm so as to provide a circumferential speed identical to that (50 mm/sec) of the photosensitive member 1 but in a direction opposite to the rotation direction indicated by an arrow A.

The core metal 2*a* of the charging roller 2 was supplied with a DC voltage of −620 volts as a charging bias voltage from a charging bias voltage supply S1. The photosensitive member 1 was charged to a surface potential of −600 volts almost equal to the voltage applied to the charging roller 2.

The photosensitive member 1 comprises aluminum of 30 mm in outer diameter coated successively with a charge generation layer, a charge transport layer and a charge injection layer. The charge generation layer was 1 $\mu$m-thick layer comprising a disazo-type charge generation pigment dispersed in polyvinyl butyral resin in a weight ratio of 2:1. The charge transport layer was 20 $\mu$m-thick layer comprising a hydrazone-type charge-transporting compound mixed in polycarbonate resin in a weight ratio of 1:1. The charge injection layer was a 10 $\mu$m-thick layer for promoting charge injection from the charging roller 2 to the charge transport layer and formed by dispersing $SnO_2$ powder as a conductive filler in a phosphazane resin in a weight ratio of 7:10.

The exposure means 3 comprises a laser beam scanner including a laser diode, a polygonal mirror, etc. The laser beam scanner 3 was operated to output a laser beam L whose intensity was modulated corresponding to time-serial electrical digital pixel signals based on objective image data. The uniformly charged surface of the rotating photosensitive member 1 was exposed to the scanning laser beam L. As a result, an electrostatic latent image corresponding to the objecting image data was formed on the surface of the photosensitive member 1.

The electrostatic latent image on the photosensitive member 1 surface was developed by the developing device 4 to form a toner image. The developing device 4 was a reversal development device using a magnetic monocomponent insulating toner (negatively chargeable toner), and included a nonmagnetic rotational developing sleeve 4*a* as a developer-carrying member enclosing therein a magnetic roll 4*b*. A developer 4*d* contained in the developing device 4 was applied in a thin layer of a controlled thickness on the rotating developing sleeve 4*a* by means of a regulating blade 4*c* whereby the toner in the developer 4*d* was provided with a charge. The developer 4*d* applied on the developing sleeve 4*a* was conveyed along with the rotation of the sleeve 4*a* to a developing region a at a position where the photosensitive member 1 and the sleeve 4*a* were opposite to each other. The sleeve 4*a* was supplied with a developing bias voltage comprising a superposition of a DC voltage of −500 volts and a rectangular AC voltage of a frequency of 1800 volts and a peak-to-peak voltage of 1600 volts from a developing bias voltage supply S2. As a result, the electrostatic image on the photosensitive member 1 was developed with the toner to form a toner image on the photosensitive member 1.

The developer 4*d* was a mixture of a toner t and conductive particles m. The toner t was prepared by subjecting a blend of a binder resin, magnetic particles and a charge control agent to melt-kneading, pulverization and classification, and by blending the resultant toner particles with a flowability improving agent as an external additive. The toner t had a weight-average particle size (D4) of 7 $\mu$m. The conductive particles m comprised conductive zinc oxide particles of 3 $\mu$m in diameter, and blended in 2 wt. parts with 100 wt. parts of the toner t. The particles m exhibited a specific resistance of $10^6$ ohm.cm, and an average particle size of 3 $\mu$m including the secondary agglomerate particles.

The image forming apparatus further included a medium-resistivity transfer roller 5 as a contact transfer means, which was abutted against the photosensitive member at a prescribed pressure to form a transfer nip b therewith. When a transfer paper p was supplied to the transfer nip b from a paper supply unit (not shown) according to prescribed timing, a prescribed transfer bias voltage was applied to the transfer roller 5 from a transfer bias voltage supply S3, whereby toner images formed on the photosensitive member 1 were sequentially transferred onto the transfer paper P supplied to the transfer nip b. The transfer roller 5 had a resistance of $5\times10^8$ ohm, and was supplied with a DC voltage of +2000 volts for transfer. More specifically, the transfer paper P introduced to the transfer nip b was conveyed under nipping through the nip b, while successively receiving on its surface toner images formed and carried on the rotating photosensitive member by transfer under the action of an electrostatic force and a pressing force.

The fixing device 6 was of a heat-fixation type. The transfer paper P having received the transferred toner image at the transfer nip b from the photosensitive member 1 was separated from the photosensitive member 1 and introduced to the fixing device 6, where the toner image was fixed thereonto and the resultant image product (print or copy) was discharged out of the apparatus.

At the transfer nip b, the toner image on the photosensitive member 1 was positively transferred onto the transfer paper P under the action of the transfer bias voltage, but the conductive particles m on the photosensitive member 1 were not positively transferred onto the transfer paper P because of their electroconductivity but were substantially held in attachment onto the photosensitive member 1. The conductive particles m and possible transfer residual toner remaining on the photosensitive member after the transfer were brought along with the rotation of the photosensitive member to the charging nip n of the charging roller 2 and attached to the charging roller 2.

Accordingly, the photosensitive member 1 was contact-charged in the state where the conductive particles m were present at the nip n between the photosensitive member 1 and the charging roller 2. Incidentally, in the initial stage of image production, since a sufficient amount of the conductive particles m (required for effective charging) could not be supplied to the charging roller surface from the developer 4*d*, the charging roller surface was coated in advance with conductive particles m.

On the other hand, the residual toner moved to the charging roller 2 was gradually discharged out of the charging roller to be removed by the developing device 4 and recycled for development again.

EXAMPLES AND COMPARATIVE EXAMPLES

Example 1

A conductive foam rubber layer-forming composition was formulated from the following ingredients.

| | |
|---|---|
| (Base rubber formulation) | |
| EPDM ("EPT 8065E", made by Mitsui Kagaku K.K.) | 100 wt. part(s) |
| Zinc oxide | 5 wt. part(s) |
| Stearic acid | 2 wt. part(s) |
| Carbon black | 10 wt. part(s) |
| Paraffin oil ("PW-380", made by Idemitsu Kosan K.K.) | 55 wt. part(s) |
| Calcium carbonate | 10 wt. part(s) |
| (Vulcanizer formulation) | |
| MBT: mercaptobenzothiazole ("NOCCELER M", made by Ohuchi Shinko K.K.) | 3 wt. part(s) |

-continued

| | |
|---|---|
| ZDNBDTC: zinc di-n-butyldithio-carbamate ("NOCCELER BZ", made by Ohuchi Shinko K.K.) | 2 wt. part(s) |
| TETDS: tetraethylthiuram disulfide ("NOCCELER TET", made by Ohuchi Shinko K.K.) | 3 wt. part(s) |
| Sulfur | 2 wt. part(s) |
| (Foaming agent) | |
| OBSHZ: 4,4'-oxybis(benzenesulfonyl hydrazide) | 0 wt. part(s) |
| ADCA: azodicarbonamide ("CELLMIKE C", made by Sankyo Kasei K.K.) | 24 wt. part(s) |
| U-FA: urea-type foaming aid ("CELLMIKE NP", made by Sankyo Kasei K.K.) | 0 wt. part(s) |

The above ingredients were kneaded on an open roll to obtain a rubber composition, and the composition was extruded into a tube, followed by primary vulcanization for 30 min. by heating at 160° C. with steam of 0.52 MPa and secondary vulcanization for 30 min. by an electric furnace heating at 160° C. Into the thus-formed tube, a core metal of 6 mm in outer diameter and 250 mm in length was inserted and the outer surface of the rubber layer was abraded to form a charging roller of 12 mm in outer diameter having a fine network-textured surface provided with concave cells giving a total cell-edge-perimeter density of 50.0 mm/mm$^2$. The foam rubber layer exhibited a specific gravity of 0.21, thus showing a foaming ratio of 4.9. The charging roller exhibited a resistance of $10^4$ ohm.

Incidentally, the primary vulcanization by heating with steam was effective for minute cell formation because the steam pressure suppressed the expansion of cells during the progress of vulcanization and foaming under heating, and the use of an appropriately selected foaming agent in a relatively large amount was effective for generating a sufficient amount of foaming gas without retarding the vulcanization to provide a foam rubber having a high foaming ratio and thin cell walls.

Figure 3:
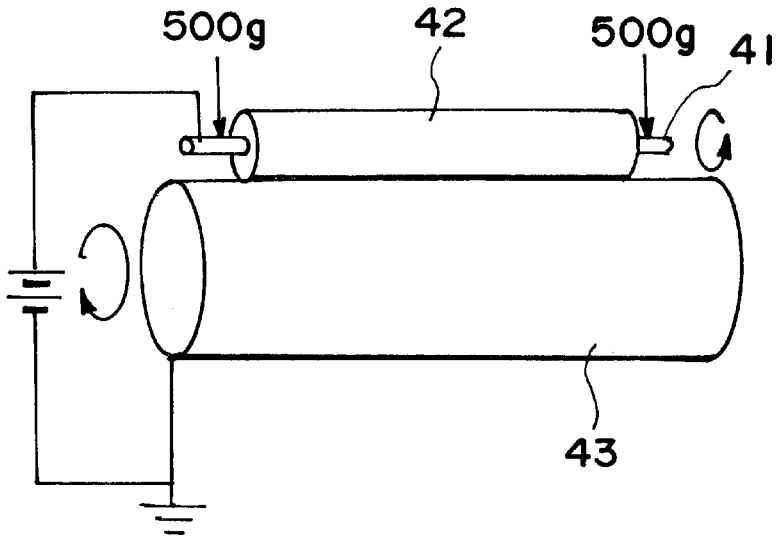
FIG. 3 illustrates an apparatus for measuring a roller resistance.
Figure 4:
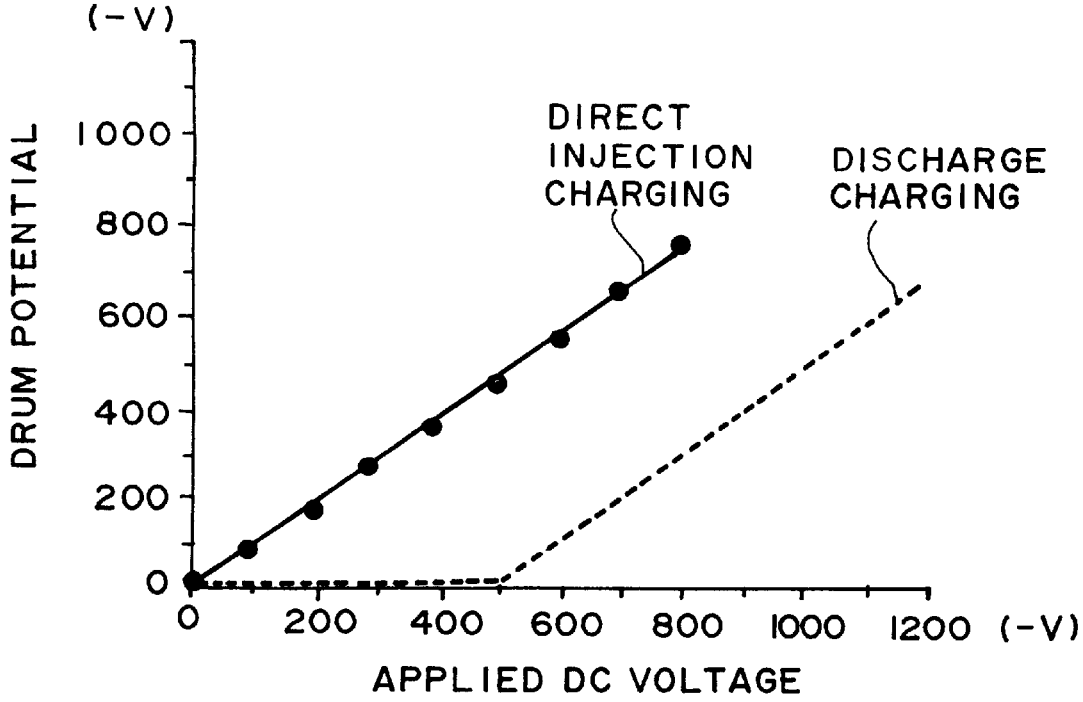
FIG. 4 is a graph showing charging characteristics according to two extreme charging mechanisms involved in a contact charging scheme.

The roller resistance values described herein are based on values measured as follows with reference to FIG. 3. A sample roller 42 is abutted against an aluminum drum 43 while applying a total load of 1 kg to the core metal 41, and a resistance is measured while applying a DC voltage of 100 volts between the core metal 41 and the aluminum drum 43.

The total cell-edge-perimeter density values described herein are based on values measured as follows. A sample roller surface is observed through an optical microscope ("DMRHC" metal microscope, made by Reica Microsystem K. K.) at a magnification of 200, and the resultant roller surface image is image-processed by an image analyzer ("Q5001W-E", made by Reica Microsystem K. K.) to measure individual cell areas, from which area-equivalent circle diameters ($d_{ceq}$) of individual surface cells, and for respective individual cells of $d_{ceq}\geqq10\ \mu$m, cell edge perimeters are calculated as $\pi\times d_{ceq}$ and summed up per unit area of 1 mm$^2$ to provide a cell edge perimeter density (mm/mm$^2$).

The above-prepared charging roller was set in the image forming system described with reference to FIG. 5, and the resultant toner image fixed on the transfer paper P was evaluated with respect to resolution of 100 $\mu$m-wide thin lines. More specifically, a large number of 100 $\mu$m-wide thin lines were formed with a spacing of 100 $\mu$m, and 20 image lines were selected at random for observation through a microscope to measure a maximum width and a minimum width along a length of 1500 $\mu$m for each line. From the measured results, the resolution was evaluated according to the following standard.

A: The maximum width and the minimum width for the 20 lines were within the range of ±10 μm from the objective width of 100 μm. This is practically evaluated as a level of providing uniform halftone image s free from irregularity.

B: The maximum width and the minimum width for the 20 lines were within the range of ±20 μm but exceeding ±10 μm. This is a level inferior to A, but may be regarded as a level of providing practically uniform halftone images substantially free from irregularity.

C: The maximum width and the minimum width for the 20 lines were within the range of ±60 μm but exceeding ±20 μm. This is a level of providing halftone images with noticeable irregularity.

The results of evaluation for the respective items are inclusively shown in Table 1 together with those of the following Examples and Comparative Examples.

Examples 2–8 and Comparative Examples 1–4

The charging rollers were prepared and evaluated in the same manner as in Example 1 except for changing the vulcanizer formulation and the foaming agent formulation of the foam rubber layer-forming composition as shown in Table 1. In Comparative Example 2, the primary vulcanization was effected by electric furnace heating at 160° C. for 30 min. unlike the other Examples (including Example 1 mentioned above) and Comparative Examples where the primary vulcanization was effected by the steam heating (at 160° C. (0.52 MPa) for 30 min.).

The results are inclusively shown in Table 1.

TABLE 1

| | Formulation (wt. parts) and evaluation results | | | | | | | | | | | |
|---|---|---|---|---|---|---|---|---|---|---|---|---|
| | Example | | | | | | | | Comparative Example | | | |
| | 1 | 2 | 3 | 4 | 5 | 6 | 7 | 8 | 1 | 2* | 3 | 4 |
| (Vulcanizer) | | | | | | | | | | | | |
| MBT | 3 | 2 | 2 | 2 | 3 | 2 | 2 | 4 | 2 | 2 | 2 | 4 |
| ZDNBTC | 2 | 1 | 1 | 1 | 2 | 1 | 1 | 1 | 1 | 1 | 1 | 2 |
| TETDS | 3 | 3 | 3 | 4 | 4 | 4 | 4 | 5 | 4 | 4 | 4 | 4 |
| Sulfur | 2 | 2 | 2 | 2 | 2 | 2 | 2 | 2 | 2 | 2 | 2 | 2 |
| (Foaming agent) | | | | | | | | | | | | |
| OBSHZ | 0 | 0 | 0 | 8 | 24 | 8 | 12 | 0 | 0 | 0 | 0 | 0 |
| ADCA | 24 | 22 | 20 | 8 | 0 | 8 | 0 | 27 | 4 | 4 | 8 | 30 |
| u-FA | 0 | 0 | 0 | 8 | 8 | 4 | 0 | 0 | 4 | 4 | 0 | 0 |
| Roller resistance (ohm.) | $10^5$ | $10^6$ | $10^6$ | $10^5$ | $10^6$ | $10^5$ | $10^5$ | $10^5$ | $10^4$ | $10^4$ | $10^5$ | $10^5$ |
| Cell edge perimeter density (mm/mm2) | 50.0 | 35.5 | 30.5 | 23.5 | 22.7 | 20.0 | 15.0 | 60.1 | 12.8 | 5.1 | 10.5 | 70.5 |
| Specific gravity | 0.21 | 0.33 | 0.42 | 0.5 | 0.63 | 0.53 | 0.5 | 0.52 | 0.84 | 0.45 | 0.6 | 0.62 |
| Foaming ratio | 4.9 | 3.2 | 2.5 | 2.1 | 1.7 | 2.0 | 2.1 | 2.0 | 1.3 | 2.3 | 1.8 | 1.7 |
| Resolution | A | A | A | A | A | A | B | B | C | C | C | C |

*Comparative Example 2: Primary vulcanization by electric furnace heating.

What is claimed is:

1. A charging device, comprising: a member to be charged, a charging member disposed so as to form a nip with the member to be charged, and electroconductive particles disposed so as to be present at the nip between the charging member and the member to be charged, wherein the charging member has a fine network-textured surface provided with concave cells giving a total cell edge perimeter per unit area of 15 mm/mm$^2$ to 60 mm/mm$^2$.

2. A charging device according to claim 1, wherein the charging member and the member to be charged are moved with a relative speed difference so as to rub each other.

3. A charging device according to claim 1, wherein the total cell edge perimeter per unit area is 20 mm/mm$^2$ to 50 mm/mm$^2$.

4. A charging device according to claim 1, wherein the fine network-textured surface of the charging member is formed of a foam material.

5. A charging device according to claim 4, wherein the foam material has a specific gravity of 0.2–0.65.

6. A charging device according to claim 1, wherein the charging member comprises a surface layer of elastomer foam having a fine network-textured surface.

7. A charging device according to claim 6, wherein the surface elastomer foam layer has a resistance of $10^4$–$10^7$ ohm.

8. A charging device according to claim 1, wherein the electroconductive particles have a specific resistance of at most $10^{12}$ ohm.cm.

9. A charging device according to claim 1, wherein the electroconductive particles have an average particle size of at most 50 μm.

10. An image forming apparatus, comprising: a photosensitive member, a charging member disposed so as to form a nip with the photosensitive member, and electroconductive particles disposed so as to be present at the nip between the charging member and the photosensitive member, wherein the charging member has a fine network-textured surface provided with concave cells giving a total cell edge perimeter per unit area of 15 mm/mm$^2$ to 60 mm/mm$^2$.

11. An image forming apparatus according to claim 10, wherein the charging member is in the form of a roller.

12. A process cartridge, comprising: a photosensitive member, a developing means and a charging means integrally supported to form a cartridge which is detachably mountable to a main assembly of an image forming apparatus, wherein the charging means includes a charging member disposed so as to form a nip with the photosensitive member, and electroconductive particles disposed so as to be present at the nip between the charging member and the member to be charged, wherein the charging member has a fine network-textured surface provided with concave cells giving a total cell edge perimeter per unit area of 15 $mm/mm^2$ to 60 $mm/mm^2$.

13. A process cartridge according to claim 12, wherein the charging member is in the form of a roller.

14. A charging roller, having a fine network-textured surface provided with concave cells giving a total cell edge perimeter per unit area of 15 $mm/mm^2$ to 60 $mm/mm^2$.

15. A charging roller according to claim 14, wherein the total cell edge perimeter per unit area is 20 $mm/mm^2$ to 50 $mm/mm^2$.

16. A charging roller according to claim 14, wherein the charging roller comprises a surface layer of elastomer foam having a fine network-textured surface.

17. A charging roller according to claim 16, wherein the surface elastomer foam layer has been formed by vulcanization of a composition comprising ethylene-propylene rubber as a base material, azodicarbonamide as a foaming agent, a thiazole compound and a dithiocarbamate compound as vulcanization promoters, and sulfur as a vulcanizer.

18. A charging roller according to claim 17, wherein the thiazole compound and dithiocarbamate compound are added in 3–5 wt. parts per 100 wt. parts of the ethylene-propylene rubber.

* * * * *

UNITED STATES PATENT AND TRADEMARK OFFICE

CERTIFICATE OF CORRECTION

PATENT NO. : 6,343,199 B1
DATED : January 29, 2002
INVENTOR(S) : Masataka Kodama It is certified that error appears in the above-identified patent and that said Letters Patent is hereby corrected as shown below:

Title page,
Item [57], ABSTRACT,
Line 4, "photosen-" should read -- charging --.
Line 5, "sitive" should be deleted.

Column 1,
Line 16, "such" should read -- such as --.
Line 67, "can not" should read -- cannot --.

Column 2,
Line 29, "mechanism." should read -- mechanism --.
Line 43, "votlage" should read -- voltage --.
Line 57, "porus" should read -- porous --.
Line 62, "surface of the" should be deleted.
Lines 63-67, should be deleted.

Column 3,
Lines 1-5, should be deleted.

Column 4,
Line 27, "area" should read -- area, --.
Line 32, "concavities" should read -- concavities, --; and "combination" should read -- combination, --.
Line 42, "cell edge" should read -- cell-edge --.
Line 61, "exhibits" should read -- exhibit --.

Column 5,
Line 54, "laye 2b" should read -- layer 2b --.
Line 55, "found" should read -- formed --.
Line 60, "rolelr" should read -- roller --.
Line 65, "cel" should read -- cell --.
Line 66, "forming" should read -- foaming --.

Column 6,
Line 3, "lownmolecular" should read -- low molecular --.
Line 9, "through" should read -- through foaming --.
Line 28, "15'60 mm/mm$^2$," should read -- 15-60 mm/mm$^2$, --.
Lines 30, 35 and 38, "ration" should read -- ratio --.
Line 42, "Forming" should read -- Foaming --.

UNITED STATES PATENT AND TRADEMARK OFFICE

CERTIFICATE OF CORRECTION

PATENT NO. : 6,343,199 B1
DATED : January 29, 2002
INVENTOR(S) : Masataka Kodama It is certified that error appears in the above-identified patent and that said Letters Patent is hereby corrected as shown below:

Column 6 cont'd,
Line 55, "104-107 ohm" should read -- $10^4$-$10^7$ ohm --.
Line 59, "shpe" should read -- shape --.

Column 7,
Line 40, "araticle" should read -- particle --.

Column 8,
Line 6, "comprises" should read -- comprised -- .
Line 19, "comprises" should read -- comprised --.
Line 27, "objecting" should read -- objective --.
Line 67, "paper p" should read -- paper p --.

Column 10,
Line 50, "(Q5001W-E"," should read -- (Q-5001W-EX", --.
Line 55, "cell edge perimeter" should read -- cell-edge-perimeter --.

Column 11,
Line 4, "image s" should read -- images --.
Table 1, Leftmost column, "density (mm/mm2)" should read -- density (mm/$mm^2$) --.

Column 12,
Line 65, "mem-" should read -- photosensitive member --.
Line 66, "ber" should be deleted.

Signed and Sealed this

Seventh Day of January, 2003

JAMES E. ROGAN
*Director of the United States Patent and Trademark Office*